US009439489B1

(12) United States Patent
Townsell

(10) Patent No.: US 9,439,489 B1
(45) Date of Patent: Sep. 13, 2016

(54) BRAIDLOC TUBE DEVICE AND METHOD

(71) Applicant: Tiana Tamara Townsell, Covington, WA (US)

(72) Inventor: Tiana Tamara Townsell, Covington, WA (US)

( * ) Notice: Subject to any disclaimer, the term of this patent is extended or adjusted under 35 U.S.C. 154(b) by 0 days.

(21) Appl. No.: 14/685,875

(22) Filed: Apr. 14, 2015

(51) Int. Cl.
*A45D 7/00* (2006.01)
*A45D 8/34* (2006.01)
*A45D 2/00* (2006.01)

(52) U.S. Cl.
CPC . *A45D 7/00* (2013.01); *A45D 8/34* (2013.01); *A45D 2002/007* (2013.01); *A45D 2007/002* (2013.01); *A45D 2007/004* (2013.01)

(58) Field of Classification Search
CPC ..... A45D 7/00; A45D 7/04; A45D 7/045; A45D 7/06; A45D 2007/002; A45D 2007/004; A45D 2007/001; A45D 2002/008; A45D 2002/007; A45D 8/00; A45D 8/34; A45D 8/36
USPC ..... 132/200, 202, 203, 204, 207, 210
See application file for complete search history.

(56) References Cited

U.S. PATENT DOCUMENTS 1,483,583 A 2/1924 Jacobs
1,520,968 A 12/1924 Sartory
1,550,930 A 8/1925 Sullivan
1,635,425 A 7/1927 Marcel
1,676,681 A 7/1928 Bolduc
1,981,362 A * 11/1934 Joyce ..... A45D 7/045 132/222
2,151,024 A * 3/1939 Gilbert ..... A45D 7/045 132/222
2,326,422 A 8/1943 Weisberger
3,101,724 A * 8/1963 Nizetich ..... A45D 19/0008 132/270
3,610,257 A * 10/1971 Hall ..... A45D 19/18 132/270
4,307,908 A * 12/1981 Donaldson ..... A45D 2/00 132/200
4,315,362 A * 2/1982 Pigford ..... A45D 2/00 163/5
5,056,538 A * 10/1991 Matula ..... A45D 19/0025 132/208
5,121,761 A 6/1992 Meister
5,472,003 A 12/1995 Frame et al.
D372,338 S 7/1996 Engel et al.
5,584,309 A 12/1996 De Beneditis et al.
5,590,670 A * 1/1997 Allred ..... A45D 8/00 132/273
5,687,751 A * 11/1997 Villani ..... A45D 8/00 132/200
5,730,161 A * 3/1998 Kohanek ..... A45D 8/34 132/212
5,775,341 A 7/1998 Abe et al.
5,810,022 A * 9/1998 Reynolds ..... A45D 8/34 132/200

(Continued)

OTHER PUBLICATIONS

9 Essential STeps for Maintaining Braids or Twists, http://blackhairspot.com/index.cfm?page=hair-talk.maintaining-box-braids-twists, pp. 1-10, unknown publication date (comment posted on Nov. 28, 2014).*

(Continued)

*Primary Examiner* — Tatiana Nobrega
(74) *Attorney, Agent, or Firm* — George A. Leone; Citadel Patent Law

(57) ABSTRACT

An esthetic hair treatment method includes providing a lengthwise contractible cylindrical evolved hair tube, where the hair tube is resiliently biased toward a preformed state. A loc of hair is inserted into a longitudinally contractible cylindrical hair tubes while the hair tube is in a lengthwise contracted or extended state. The loc of human hair extends lengthwise through the hair tube. The hair tube containing the loc of hair is permitted to return to the preformed state after insertion of the loc of hair. The hair tube is applied in the preformed state to allow natural hair growth to lie flat and straighten. The hair tube can be used as an adornment until the natural hair growth reaches a selected length. The process is repeated as needed for additional locs of hair.

13 Claims, 13 Drawing Sheets

(56) References Cited

U.S. PATENT DOCUMENTS

| | | | | | |
|---|---|---|---|---|---|
| 5,881,736 | A * | 3/1999 | Turner | A45D 8/34 | 132/200 |
| 5,967,151 | A * | 10/1999 | Villani | A45D 8/00 | 132/200 |
| 5,970,991 | A | 10/1999 | Srivastava | | |
| 6,016,813 | A * | 1/2000 | Kennedy | A45D 8/34 | 132/200 |
| 6,035,864 | A * | 3/2000 | Kennedy | A45D 8/34 | 132/200 |
| D442,765 | S | 5/2001 | Newman | | |
| 6,260,555 | B1 | 7/2001 | Natvig | | |
| 6,276,368 | B1 | 8/2001 | Giamalva | | |
| 6,425,405 | B1 | 7/2002 | McRoberts | | |
| 6,647,989 | B1 | 11/2003 | De Benedictis | | |
| 6,665,876 | B1 | 12/2003 | Newman | | |
| 7,156,103 | B2 * | 1/2007 | Coleman | A45D 8/12 | 132/200 |
| 7,581,547 | B2 | 9/2009 | Pena | | |
| 7,789,093 | B2 * | 9/2010 | Tojo | A45D 19/0025 | 132/207 |
| 8,074,297 | B2 | 12/2011 | Graham | | |
| 8,074,664 | B2 | 12/2011 | Ruckdeschel | | |
| 8,783,269 | B1 | 7/2014 | Deer | | |
| 2005/0109361 | A1 * | 5/2005 | Klug | A45D 8/34 | 132/275 |
| 2006/0179544 | A1 | 8/2006 | Knievel | | |
| 2007/0068547 | A1 * | 3/2007 | Gurth | A45D 2/02 | 132/200 |
| 2008/0202547 | A1 * | 8/2008 | Blye | A45D 8/36 | 132/270 |
| 2009/0151048 | A1 | 6/2009 | Laury | | |
| 2012/0023642 | A1 | 2/2012 | Holland | | |
| 2015/0173481 | A1 * | 6/2015 | Durham | A45D 8/34 | 132/200 |

OTHER PUBLICATIONS

Part1: Protective Style Challenge Intro Post—Meet the Participants!, Beads, Braids & Beyond, http://beadsbraidsbeyond.blogspot.com/2012_04_01_archive.html, Apr. 27, 2012, pp. 1-24.*

* cited by examiner

BRAIDLOC TUBE DEVICE AND METHOD

TECHNICAL FIELD

The present invention relates to hairstyling, more particularly, to devices for and methods of treatment of growing natural hair, and still more particularly to the imparting of a designed form, such as by use of a hair tube for straightening, coloring, adding slight volume, and decorating a growing loc of natural hair.

BACKGROUND

There are many known devices which can be used to hold hair in place, extend hair, enclose hair, etc. These items are typically used to divide hair into sections during chemical treatments and the creation of hair extensions. While such devices are useful for their intended purposes, no device or method currently exists to adequately color, straighten, add slight volume to, decorate, and grow the natural hair without the use of heat or chemicals. Thus, there remains a need for a hair treatment device which can adequately perform these functions. It is these and other problems in the prior art that the present invention addresses.

In many instances in the modern hair dressing parlors, and similar operations or establishments, permanent hair treatment devices for imparting hair texture use tubes in the treatment method. Such treatment methods typically employ electric heaters together with tubes of various types for steaming hair. These tubes are generally used for waving or curling hair and are very clumsy, time consuming to use, and are otherwise inconvenient. As a further drawback, a secondary device is usually needed to keep the hair tube in place. As another step in the process the hair needs to be treated with a liquid or cream chemical hair treatment substance in order to retain the formation imparted. Heat is also often applied to the hair while it is within the tubes. When coloring hair is part of the process a chemical dyeing agent is supplied into the tube and is applied inside the tube to the hair. Such applications may lead to extreme hair damage.

Additionally, people have long sought to adorn their natural hair by placing removable articles and materials in the hair. Such removable articles and materials may include beads of woods and natural metals, feathers, ribbon, leather, and other devices, to name but a few. One of the technical problems which must be solved in providing such adornments lies in the mounting of the esthetic member to the hair. Preferably, the mounting element should engage the hair in a secure and durable manner, be of slight weight to avoid hair harm and breakage, yet be readily installable and readily removed. Ideally, such installations and/or removals should be effected without use of a visible structure for engaging the hair so as not to interfere with the esthetic effect there being imparted.

Permanently straightening growing human hair typically requires the use of straightening chemicals. It is difficult during this hair treatment process to examine the hair for the purposes of determining when the chemical process has been carried out to the desired extent. If unduly prolonged, the process will cause injury to the hair and scalp.

Electronic pressing devices or heated metal combs are then typically applied to the hair in conjunction with oils causing the hair to be straightened. The resultant straightening remains over a period of time notwithstanding that the hair is moistened or even cleansed, all of which may severely damage the hair, have injurious effects, and causes hair breakage. To avoid such damage a process is needed which alleviates the need for a secondary holding device, heat, and chemical hair treatment substances.

In order for most highly textured natural hair to grow and retain length, it must not be subjected to heavy manipulation because it is extremely prone to breakage. Further, because the hair is textured, it has an elasticity that often prevents the true length of the hair from showing, referred to by those of skill in the art, as "shrinkage". The inventor's research has revealed that there is a large market of people with highly textured hair that would like a natural hair care option to straighten, color, and add slight volume to their hair, an option which could alleviate damage and allow their hair to show length, grow, and be healthy with minimal manipulation.

In many instances in modern hair dressing parlors, and similar operations or establishments, there are very few safe options to enhance the appearance of length and to avoid heavy manipulation of the natural textured hair. One option is to braid the natural hair so that the weight of the hair itself pulls the coils down and shows a more accurate reading of the length of the hair. This option requires the hair to be re-braided constantly after a few months of time or less, in order to keep a neat appearance in the hairstyle and thus may cause pain to the sensitive scalp due to constant hair jerking and be quite costly and disadvantage those without adequate funds. A second option is manipulating the natural hair into a locked hairstyle, like dreadlocks. Many people who have decided to style their natural hair in dreadlocks are left unsatisfied due to the permanence and other drawbacks of this styling option.

Having in mind these difficulties, presented herein is an exceptionally novel hair tube for the purpose of overcoming the drawbacks of the above-described conventional art which fills a void not currently being met in the marketplace. In contrast to known methods and devices, application of the novel hair tube allows natural hair to look neat and fresh as it grows out and highly textured natural hair retains length due to very low manipulation. The combination of more length and volume is possible as compared to previous methods. The new methods and devices described herein allow easy day to day hair management, can be used in conjunction with a healthy hair product system, promote and retain growth, provide flexible hair styling options, allow for fun experimenting with different hair colors without damage, and are appropriate for ages 3 and up.

BRIEF SUMMARY OF THE DISCLOSURE

This summary is provided to introduce, in a simplified form, a selection of concepts that are further described below in the Detailed Description. This summary is not intended to identify key features of the claimed subject matter, nor is it intended to be used as an aid in determining the scope of the claimed subject matter.

In one aspect, an esthetic hair treatment method includes providing a lengthwise contractible cylindrical evolved hair tube, where the hair tube is resiliently biased toward a preformed state. At least one loc of hair is inserted into at least one longitudinally contractible cylindrical hair tube while the at least one hair tube is in a lengthwise contracted or extended state, said at least one loc of human hair extending lengthwise through the at least one hair tube. The at least one hair tube containing the at least one loc of hair is permitted to return to the preformed state after insertion of each loc of hair into each hair tube. The at least one hair tube is applied in the preformed state to allow natural hair growth to lie flat and straighten. The at least one hair tube can be used as an adornment until the natural hair growth reaches a selected length.

In yet another aspect, an esthetic hair adornment device is provided including a cylindrical outer sheet adapted to enclose a growing loc of natural hair, said outer sheet having protective wall of interwoven fibers extending lengthwise, where the weave is adapted to block debris and form spaces for hair treating substances to gain access to said growing natural hair within. A cylindrical inner lining is positioned within said outer sheet. The inner lining and the outer sheet are telescoped together to form a hair tube, where the weave of the outer sheet is constructed with a pattern adapted to block debris and form spaces for hair treating substances to gain access to growing natural hair inserted within the hair tube.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 14A schematically illustrates a magnified top view of the inner lining and outer sheet highlighting the interwoven fibers and the spaces there between.

FIG. 14B schematically illustrates a more detailed exploded top view of the inner lining and outer sheet highlighting the interwoven fibers and the spaces there between.

Figure 1A:
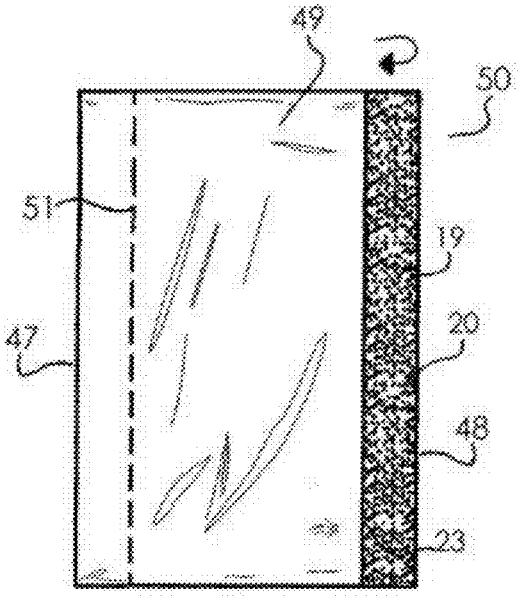
FIG. 1A schematically Illustrates a top view of a pair of rectangular sheets that produce an evolved hair tube showing in combination the inner lining of the tube, the interwoven fibers of the outer sheet of the tube, and indications of the fabrics being invisibly connected.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE PREFERRED EMBODIMENTS

The following disclosure describes devices and methods for employing braidloc tubes in hairstyling. Several features of methods and systems in accordance with example embodiments are set forth and described in the figures. It will be appreciated that methods and systems in accordance with other example embodiments can include additional procedures or features different than those shown in the figures. Example embodiments are described herein with respect to braidloc tubes for human hair. However, it will be understood that these examples are for the purpose of illustrating the principles, and that the invention is not so limited. Additionally, methods and systems in accordance with some example embodiments may not include all of the features shown in the figures.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

DEFINITIONS

Generally, as used herein, the following terms have the following meanings when used within the context of hairstyling.

"Adapted hair tube" and/or "Evolved hair tube": As used herein these terms both refer to the hair tube disclosed herein which has been adapted to fit the needs of a new generation. The traditional use of a hair tube has been changed to improve and make it fit for the particular purpose of serving a society with additional time constraints, the remaining need for versatility and style and a will to do better by our planet. The evolved hair tube is clean and green compared to tubes in past technology that use messy creams and chemicals that harm the earth.

"Braidloc Tubes" or "Hair Tubes": As used herein refer to novel hair treating devices worn in Nubian Braidlocs and functioning maximally when used within The Nubian Braidloc System.

"Nubian Braidlocs": As used herein refer to the unique hairstyle worn with Braidloc Tubes, which could be described as a fusion between micro-braids, two-strand twists, and evolved geni-locs.

"The Nubian Braidloc System": As used herein refers to a hair care system for maintaining Nubian Braidlocs comprising of healthy hair products, maintenance and routines that have been proven to work well with Braidloc Tubes and promote hair growth.

"Growing Loc of Natural Hair": As used herein refers to the visible new hair growth of which is comprised of the natural hair texture and of which is gathered into a loc.

"Loc": As used herein usually refers to a small grouping of about 100 strands of hair or less.

"Loc of Human Hair": As used herein refers to hair strands that have been naturally grown from the scalp of the product user and may be chemically altered in some fashion which have been formed into a loc.

"Small Plurality": As used in this description is defined as a grouping of 5 or less.

Generally, disclosed herein is a permanent evolved hair tube with an esthetic component, which may be used repeatedly and one which may be very easily and quickly placed onto the loc of human hair, which will hold therein and which may be very easily and quickly removed after the desired duration of time which may be up to 12 months, or after the natural hair growth has reached a selected length. Removal is affected by gently pinching the hair between the scalp and the tube and then gently pulling and guiding the tube down the hair shaft.

Referring now to FIG. 1A, a top view of a pair of rectangular sheets that produce an evolved hair tube showing in combination the inner lining of the tube, the interwoven fibers of the outer sheet of the tube, and indications of the fabrics being invisibly connected (i.e the connection is imperceptible to the naked eye) is schematically Illustrated. A hair tube 50 is formed from a pair of rectangular sheets 49 and 23 that are aligned along their longitudinal directions. In one useful example, an improved hair tube 50 may advantageously be constructed of fabric comprising inner sheet 49 serving as an inner lining, and outer sheet 23. The inner and outer sheets are invisibly connected together along segmented line 51 and suitable for use on all hair textures (straight, wavy, chemically altered, etc.) so that the tubes 50 may be purchased by hairdressers for use on any client.

Figure 1B:
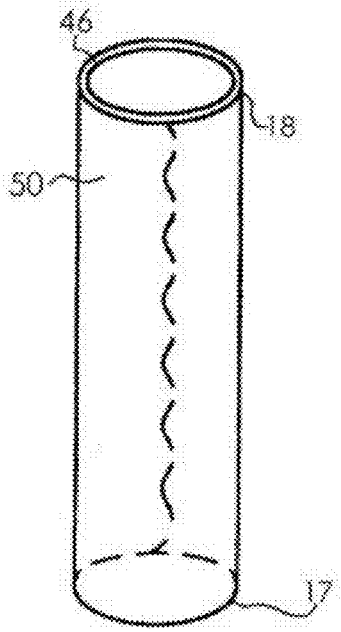
FIG. 1B schematically illustrates a front perspective aerial internal view of a novel hair tube, where the hair tube is in a closed, circular configuration after the sheets are joined by stitching their corresponding side ends.

Still referring to FIG. 1A and additionally to FIG. 1B where a front perspective internal view of the novel hair tube is shown. The pair of sheets 49, 23 are formed into the tube 50 by stitching their corresponding side ends together at the lengthwise side ends 47 and 48 of the tube 50. As a result the hair tube 50 has closed, circular configuration with an interior volume 46 for receiving hair. In one useful example, each sheet comprises soft, supple and pliable material so as to impart flexibility to the resultant tube 50. When in use, the outer sheet 23 protects the growing loc of natural hair in the hair tube from debris from outside elements, and it also imparts volume thereto. Color treatments are also allowed to be transferred from the hair tube to the hair contained within the hair tube by the method of coating.

Other preexisting tubes, as sold, are generally cylindrical throughout and there is a loss of time due to the pressing of the inner end of the tube around the hair. The unique features disclosed herein allow the adapted hair tubes 50 to save time by imparting three treatments at once due to the ability to slide onto the loc of human hair 22 with reduced friction. Material choice is fundamental to the design as it prevents breakage to textured natural hair, caused from entangling into the cylinder and in many cases, friction with the cylinder, which is inevitable when using other construction materials.

The construction material also allows this product to be functional during virtually all day and night activities. The advanced hair tubes 50 are of an improved type which can also be readily secured without tying to the growing loc of natural hair 24.

Figure 1C:
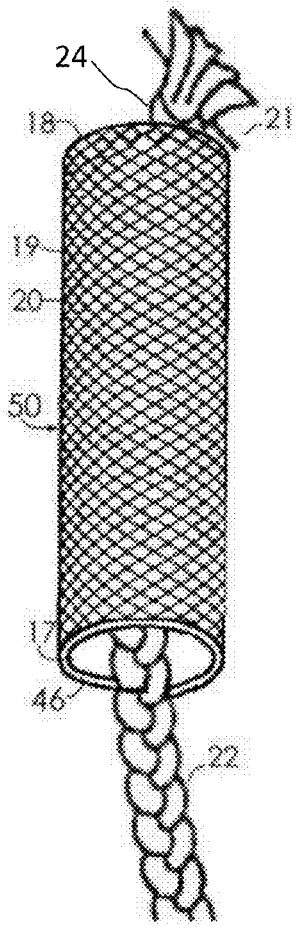
FIG. 1C schematically illustrates the advanced hair tube extended from a contracted state with the growing loc of natural hair extending from the scalp and into the tube.
Figure 2A:
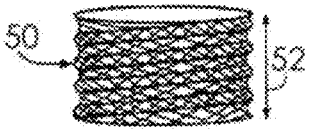
FIG. 2A-FIG. 2C schematically illustrate the adapted tube in various contracted states and in the extended state.
Figure 2B:
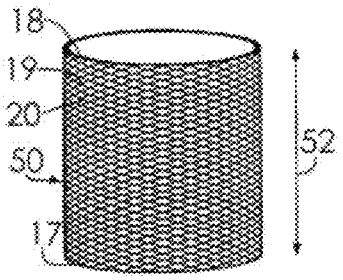
Figure 2C:
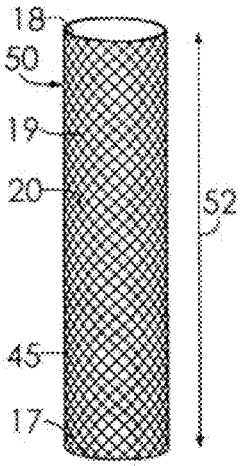

As described hereinbefore with respect to FIG. 1C and FIG. 2C, the evolved hair tube 50 has a wall formed of elements comprising interwoven fibers 19, 20 extending at an angle inclined to a longitudinal dimension 52 of the hair tube 50. While the wall of the advanced hair tube 50 may conveniently be formed of interwoven fibers 19, 20, the wall of the hair tube 50 may be formed in a different manner not using interwoven fibers 19, 20.

For example instead of fibers which are interwoven 19, 20, the wall may be formed of fibers or other elements which extend cross one another and are bonded together at locations at which the fibers or other elements cross one another. The wall of the improved hair tube 50 may be formed by bonding fibers or other elements together or the fibers or other elements may be formed integrally in the required bonded relationship for example by a molding process.

The sheet element 23 forming the outer sheet of the modified hair tube 50 is flexible and preferably made of solid velour, costume suede, crushed panne velvet, performance knit, microsuede, satin ribbon, silk, alova solid, knit jet set, moleskin, silky solid charmeuse, or faux fur and may be of other synthetic fibers or natural fibers and preferably materials that do not cause chemical reactions, in particular, corrosion and discoloration.

If desired the sheet element 23 may be elastic or nylon and resiliently extendible, may impart hue and other optical effects such as sparkle, reflection, and refraction, may be formed displaying sports team colors or logos, as well as other prints and textures or be furnished with suitable electric heat resistances.

When the wall of the adapted hair tube 50 is a mesh formed by fibers or other elements bonded together or formed integrally it will be appreciated that the elements or the interconnections between the elements or both the elements and the interconnections there between are sufficiently flexible to permit the required contraction and extension of the hair tube 50.

Referring now jointly to FIG. 2A, FIG. 2B and FIG. 2C, an example of an adapted hair tube in various contracted states and in an extended state is schematically illustrated. The generally cylindrical hair tube 50 has a wall formed of elements comprising interwoven fibers 19, 20 extending at an angle inclined to a longitudinal reference 52 of the tube 50, where the longitudinal reference is generally parallel to wall of the hair tube 50. Accordingly the adapted hair tube 50 may be contracted into a lengthwise state as in FIGS. 2A and 2B or the tube 50 may be in an extended state as in FIG. 2C.

Figure 3:
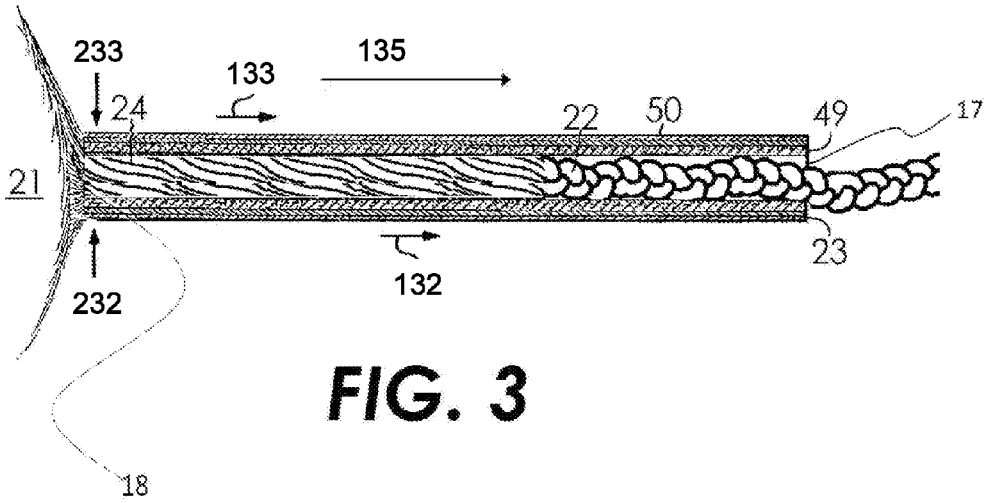
FIG. 3 schematically illustrates a longitudinal sectional view through the inner lining and outer sheet and showing a growing loc of natural hair in a generally straight formation.

Referring now to FIG. 1C, the advanced hair tube extended from a contracted state with the growing loc of natural hair extending from the scalp and into the tube is schematically illustrated. A projecting ligament of a coiled growing loc of natural hair 24 from the scalp 21 (as shown in FIG. 3) is pulled through the tube 50 and the projecting end thereof 22. After insertion of the loc of human hair 22 through the evolved hair tube 50, the loc of human hair 22 is gripped tight between the walls of the tube 50, and the hair tube 50 is extended as described hereinbelow. As described above, the characteristic expansion and contraction properties of the hair tube 50 facilitate the insertion of a loc of human hair 22 through a first open end 17, through the length of the hair tube 50 and out through a second open end 18.

Referring now to FIG. 3 a longitudinal sectional view through the inner lining and outer sheet and showing a growing loc of natural hair in a generally straight formation is schematically illustrated. With the hair tube 50 in the extended state the hair tube 50 is manipulated to a determined form so as to cause the walls of the hair tube 50 to move inwards and compress the hairs of the ligament of the growing loc of natural hair 24 together imparting the desired straight form, desired color, and slight volume to the growing loc of natural hair 24 contained in the hair tube 50.

Figure 13:
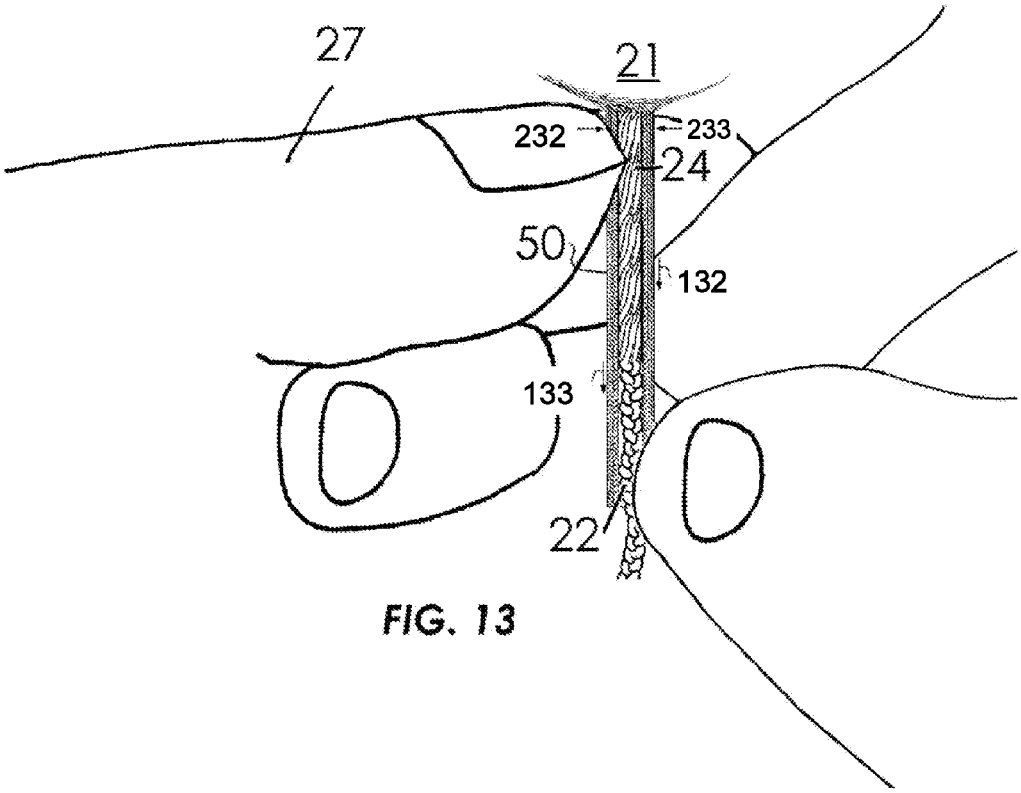
FIG. 13 schematically illustrates the flattening and shaping process of the growing loc of natural hair in the adapted hair tube.
Figure 16:
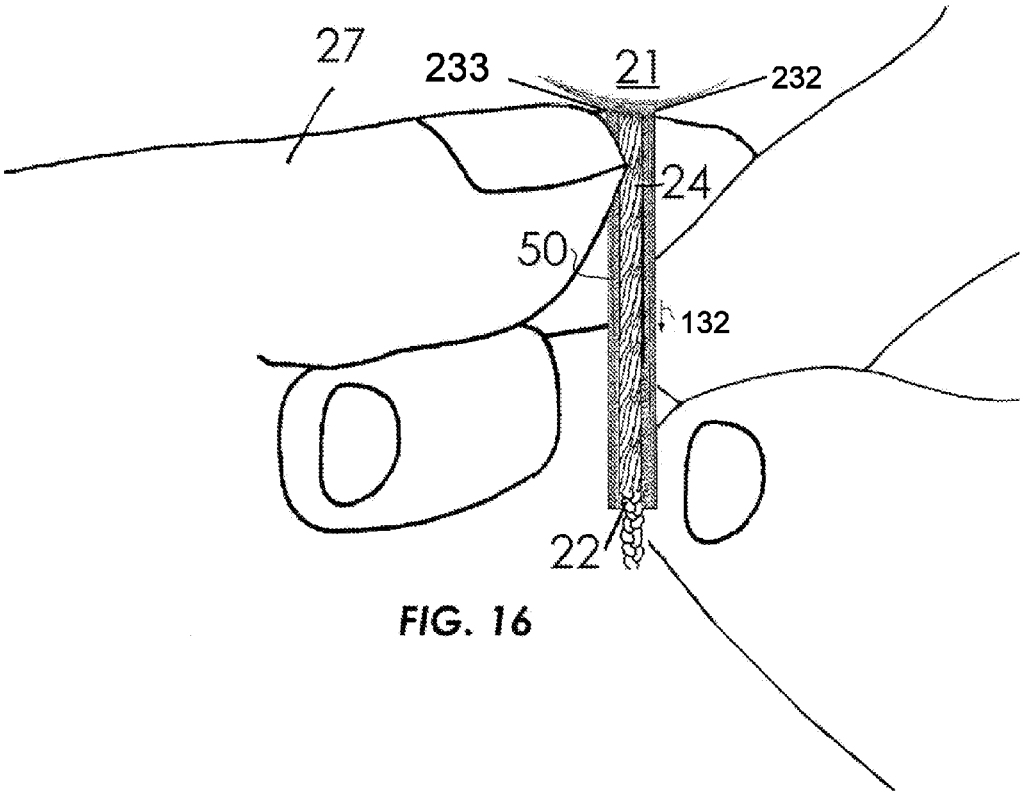
FIG. 16 schematically illustrates the removal process of the growing loc of natural hair out of the evolved hair tube.

Referring now to FIG. 13, the flattening and shaping process of the growing loc of natural hair in the adapted hair tube is schematically illustrated. In the illustrated form of manipulation, a growing loc of natural hair 24 is flattened about a longitudinal axis and the dimensions of the modified hair tube 50 in conjunction with manual pressure 232, 233 cause the wall of the hair tube 50 to flatten, as a result the growing loc of natural hair 24 contained within the hair tube 50 is caused to assume a generally straight formation, and the growing loc of natural hair 24 contained therein may be compacted lengthwise to a desired extent. After the prescribed time period or after the hair growth has reached a selected length, the growing loc of natural hair 24 is released from the confines of the adapted hair tube 50 by applying manual pressure 232, 233 and sliding the tube downward to facilitate withdrawal of the hair tube 50 from the loc of human hair 22 as described and shown below with reference to FIG. 16.

Figure 4:
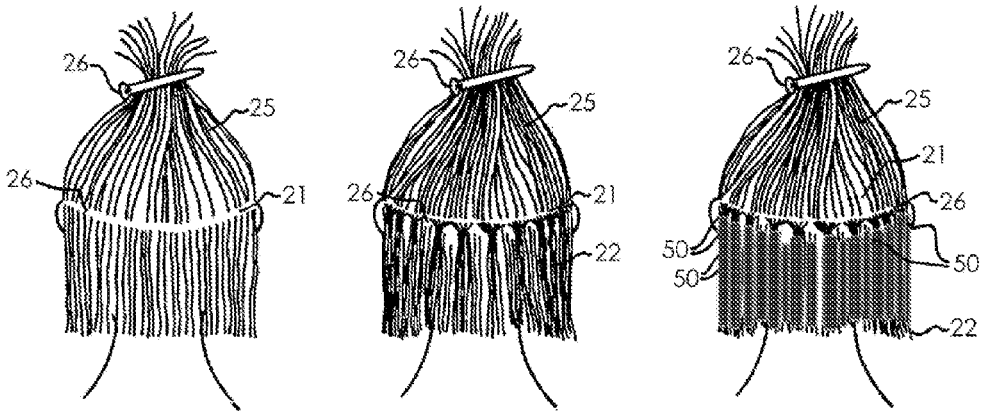
FIG. 4 schematically illustrates a progression from left to right of the back side of a person's head upon which the method of the present invention is practiced.

Referring now to FIG. 4, the back side of a person's head upon which the method of the present invention is practiced is schematically illustrated in a progression from left to right. A plurality of hair tubes 50 are applied to, and mechanical engage with the hair 22, 24 itself rather than relying upon engagement with the head, ears, forehead, or other parts of the anatomy and without using adhesives, elastic bands, or weaving, etc. In one example, the hair tube is applied by encircling or sandwiching the growing loc of natural hair 24 and the projecting end thereof 22 in a manner that avoids potential damage to the hair 22, 24 and the adhesion due to the small diameter of the hair tube is strong enough to prevent most unintended disengagement or slippage. Once removed, each loc of human hair is easily combed out of the preparatory hairstyle, shampooed, and may be restyled.

Figure 14A:
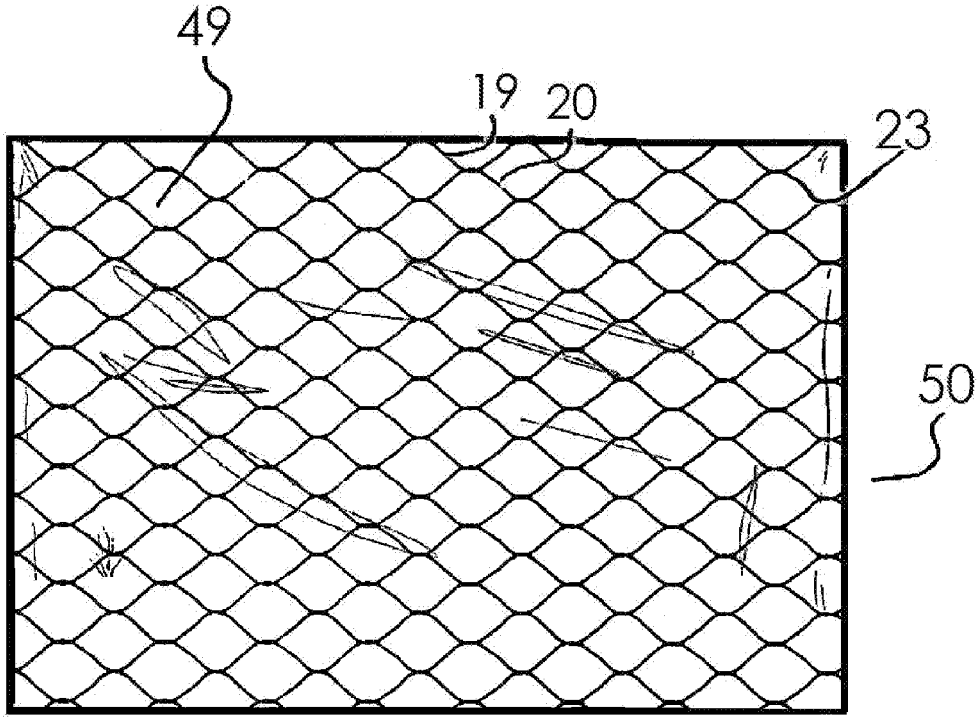
Figure 14B:
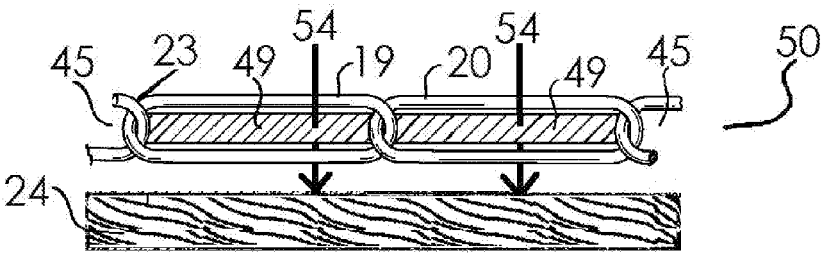

Referring now to FIG. 14A and FIG. 14B, the inner lining 49 is comprised of a smooth interior and compresses the new natural hair growth 24, allowing the growing loc of natural hair 24 to lay flat, become straight, and thus preventing the growing loc of natural hair 24 from matting as it grows out without manipulation. The inner lining 49 preferably consists of satin, silk, or other non-absorbent material capable of allowing products to seep 54 through, access and remain in the hair 22, 24 until rinsed out.

The interwoven nature of the adapted hair tube 50 is formed so that the hair tube 50, when used, is in condition to be compressed to fit closely around the growing loc of natural hair 24 near the head and there are small air spaces 45 in the hair tube 50. The air spaces 45 and the non-absorbent component underneath the hair 22, 24 within the evolved hair tube 50 acts to properly retain cleanliness and moisture during the course of use. Where applied, shampoo and conditioner immediately surround the growing loc of natural hair 24 within the hair tube 50. This is a decided advantage of the construction choice because these products may be leeched from the hair 22, 24 when using absorbable material and this inner lining 49 allows shampoo, conditioners, and oils to penetrate through the fabric and to the covered hair 22, 24 when being cleansed and maintained.

Figure 10:
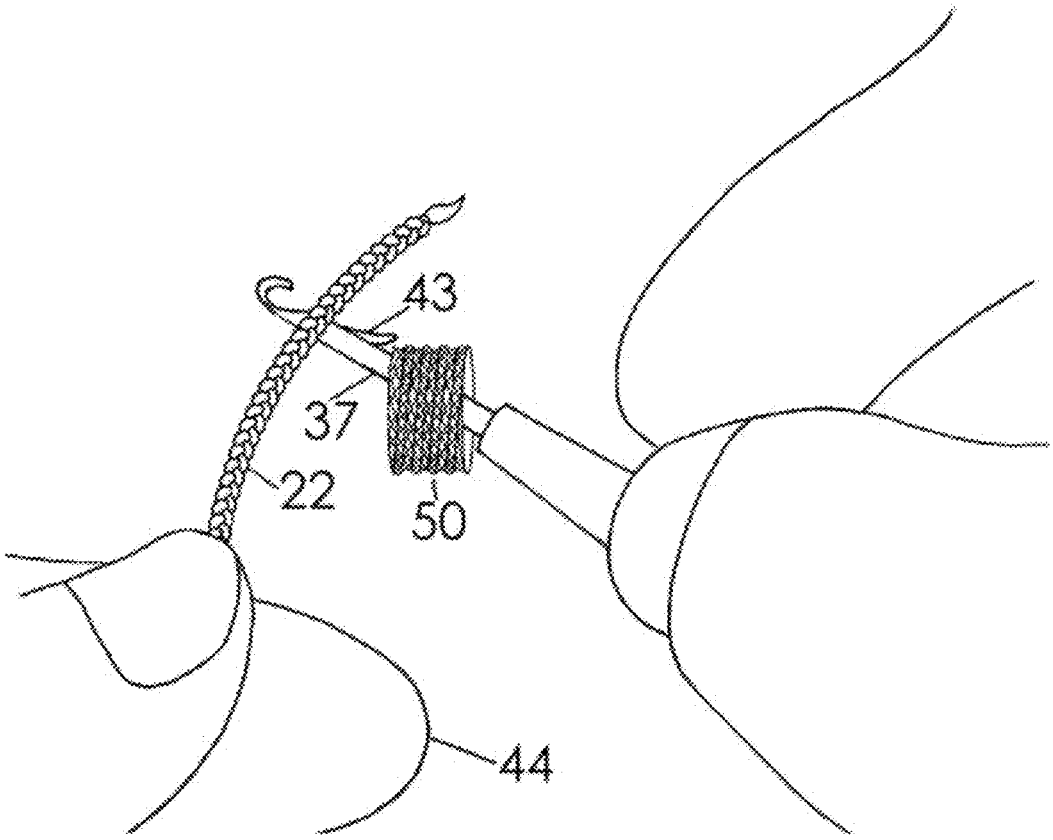
FIG. 10-FIG. 12 schematically illustrate examples of insertion processes for a loc of human hair into the advanced hair tube.

The inner lining 49 is invisibly connected to the outer sheet 23 and both are applied over the loc of natural hair 24 at the same time as shown in FIG. 10, for example. As a result both inner 49 and outer 23 surfaces are moistened and the inner lining 49 releases a greater quantity of moisture to the new natural hair growth 24 than the outer sheet 23 which may be comprised of heavier or more porous interwoven fibers 19, 20 and this advantage insures sufficient moisture for operation and variation of outward appearance in the device itself.

The interwoven fibers 19, 20 of the advanced hair tube 50 are small enough to prevent everyday debris from penetrating the growing loc of natural hair 24 within the tube 50, but absorbent enough to adequately hold and release shampoo and conditioner so the hair 22, 24 can be cleansed and moisturized. Due to the materials used to construct the hair tube and its permanent nature, an applied hair tube 50 is still capable of air drying without destruction after being cleansed.

Referring again to FIG. 10, the length of the modified hair tube 50 is set appropriately depending on the length of the new hair growth 24 to be treated, and is preferably longer than the length of the new hair growth 24 to be treated. In the drawings, the loc of human hair 22 is shown as extending through and beyond the adapted hair tube 50. It is to be understood that the length of the evolved hair tube 50 relative to the length of the new natural hair growth 24 may be such that, when the hair tube 50 is in the extended state, the loc of human hair 22 only partially extends out of the hair tube 50.

Consequently, in an example embodiment the devices and methods described herein are directed to a predetermined length of hair strands. The hair strands need to be at least 3 inches in length for proper use, and the projecting end of the loc of human hair 22 preferably protrudes at least 1½ inches from the advanced hair tube to be firmly secure to the growing loc of natural hair 24 and the projecting end 22 thereof.

Returning to the process shown in FIG. 4 while still jointly referring to FIG. 1C, at step A, preparatory to using the device in the treatment of a growing loc of natural hair 24, each coil of hair 25 is first separated 26 from the other hair on a scalp 21 and arranged into a loc which is characterized by:

a. braiding the natural hair into tiny braids, recognized by those of skill in the art, as "micro-braids" 22,
b. the more sensitive areas of the hair, as recognized by those of skill in the art, are twisted into two-strand twists rather than micro-braids 22.

Having done this all hair textures are compatible with the diameter of the improved hair tube 50 although it is specifically designed to fulfill the unique needs of a particular hair texture and after a time period, when there is visible new natural hair growth 24, the loc of human hair 22, is drawn through the first open end 17 of the hair tube 50 into and through the hair tube 50 entrapping the hair 22, 24 thereby, securing the adornment thereto (see FIGS. 8 and 12) and thus allowing the growing loc of natural hair 24 to grow through the tube 50. The hair tubes may also be applied immediately after the hair is put into locs and twists.

It is the inner lining composition of the modified hair tube 50 that allows the tube 50 to be readily slipped over a loc of human hair 22, the ligaments of such loc of human hair 22 being then sealed snuggly into the adjacent wall of the applied tube 50 by means of enclosure.

Referring again to FIG. 3, the position of the adapted hair tube 50 along the length of the loc of human hair 22 may then be adjusted such that the second open end 18 of the hair tube 50 lies adjacent the root ends of the growing loc of natural hair 24 and is directly touching the scalp 21. The second open end 18 of the evolved hair tube 50 adjacent the head is pressed in the direction of arrows 132, 133 closely about the loc of natural hair 24 within the tube 50 and the opposite hand is used to smooth and constrict the tube 50 in a longitudinal flattening direction 135 lengthwise of the hair shaft so that the tube 50 and the growing hairs 24 lay flat in order to prevent relative displacement of the growing loc of natural hair 24. This process is repeated until all new hair growth is covered with a permanent treatment device 50. However, if desired the advanced hair tube 50 may be located at any position along the lateral length of the loc of human hair 22.

Generally, less than 200 improved hair tubes 50 are used almost simultaneously in treating a head of growing locs of natural hair 24. Each growing loc of natural hair 24 under treatment may be separately examined as the condition of each growing loc of natural hair 24 may be different and may require different treatment.

While the evolved hair tube 50 has been described hereinbefore as being of woven construction, other constructions that result in a soft outer sheet 23, spaces 45 (including and unlimited to perforations or suitable vents), and permit the hair tube 50 to be manipulated in the desired manner may be utilized.

It will be recognized by those of skill in the art having the benefit of this disclosure that the first open end 17 may have other shapes (ex. square, polygonal, etc.) consequently, the invention is considered unlimited to the circular opening chosen for purposes of disclosure. The invention is intended to include any and all suitable opening shapes and thereby unlimited to a particular shape, length or decorative pattern.

Figure 15A:
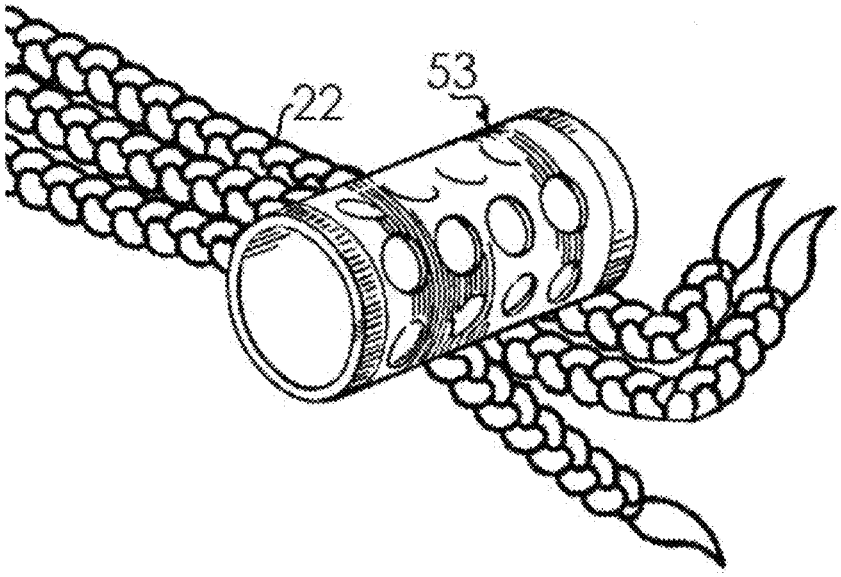
FIG. 15A and FIG. 15B schematically illustrate the bending capabilities of the evolved hair tube which allows for styling of the loc of human hair outside of the tube.
Figure 15B:
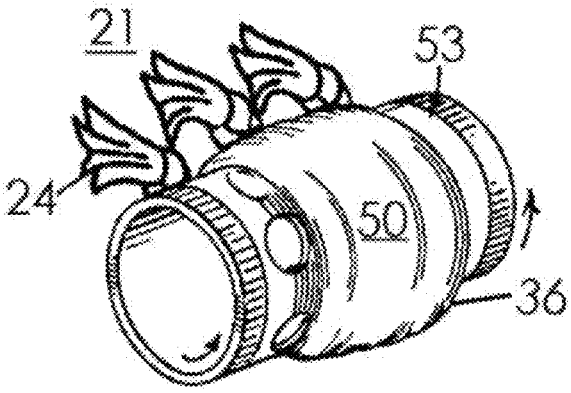

It will be appreciated that after the loc of human hair 22 is put into the advanced hair tube 50, the growing loc of natural hair 24 will remain permanently straightened for as long as the tube 50 is in place. The bending 36 of the improved hair tube allows for styling of the loc of human hair 22 outside of the tube 50. For example, as shown in FIG. 15A and FIG. 15B, if the loc of human hair 22 is put onto rollers 53, the roller 53 can be rolled up and onto the modified hair tube 50 to reach the scalp 21. When the rollers 53 are released, only the loc of human hair 22 outside of the tube 50 will curl.

Moreover, the hair tube itself is the treating agent which will automatically prevent hair, other than the hair 22, 24 inserted into the hair tube 50, from being colored, straightened, imparted with volume 46, or otherwise affected. Accordingly, the treatment using the evolved hair tube 50 of the present embodiment is suitable for partially coloring, partially straightening, and partially adding volume 46 to the hair on one's head. Further, the treating agent is contained in the advanced hair tube 50 in a relatively sealed state thus the latter is advantageous in that the treatments can be performed efficiently and that the negative effects, such as smarting of the eyes from volatile components and chemical burns, can be prevented.

Figure 11:
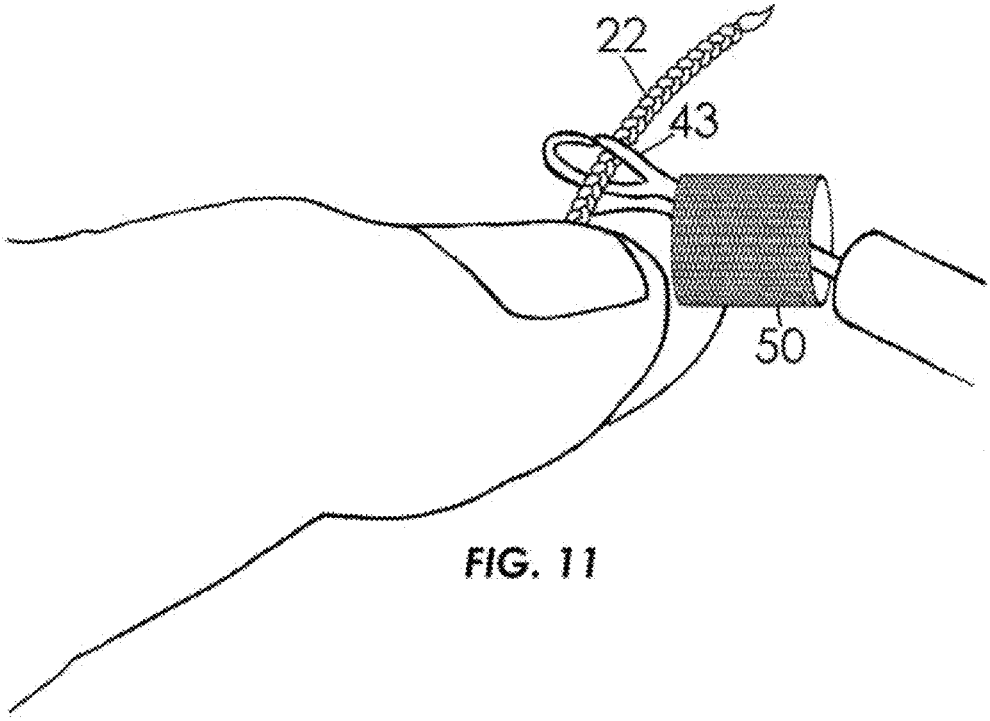

As described with reference, for example, to FIG. 3, the improved hair tube 50 may have a generally circular cross-section. After inserting of the loc of human hair 22 into the tube 50, the loc of human hair 22 is gripped securely between the walls of the tube 50. The hair tube 50 is then manipulated and flattened to a final form to impart a desired straight formation, desired color, and add volume 46 to the growing loc of natural hair 24 contained in the hair tube 50. Accordingly it is convenient when it is desired to insert a loc of human hair 22 into the modified hair tube 50, to initially contract the hair tube 50 to permit insertion of the loc of human hair 22 contained in the hair tube 50 as shown in FIGS. 10 and 11. It should be noted that the color is in and on the tube itself and there are over 40 color options to choose from.

Figure 5:
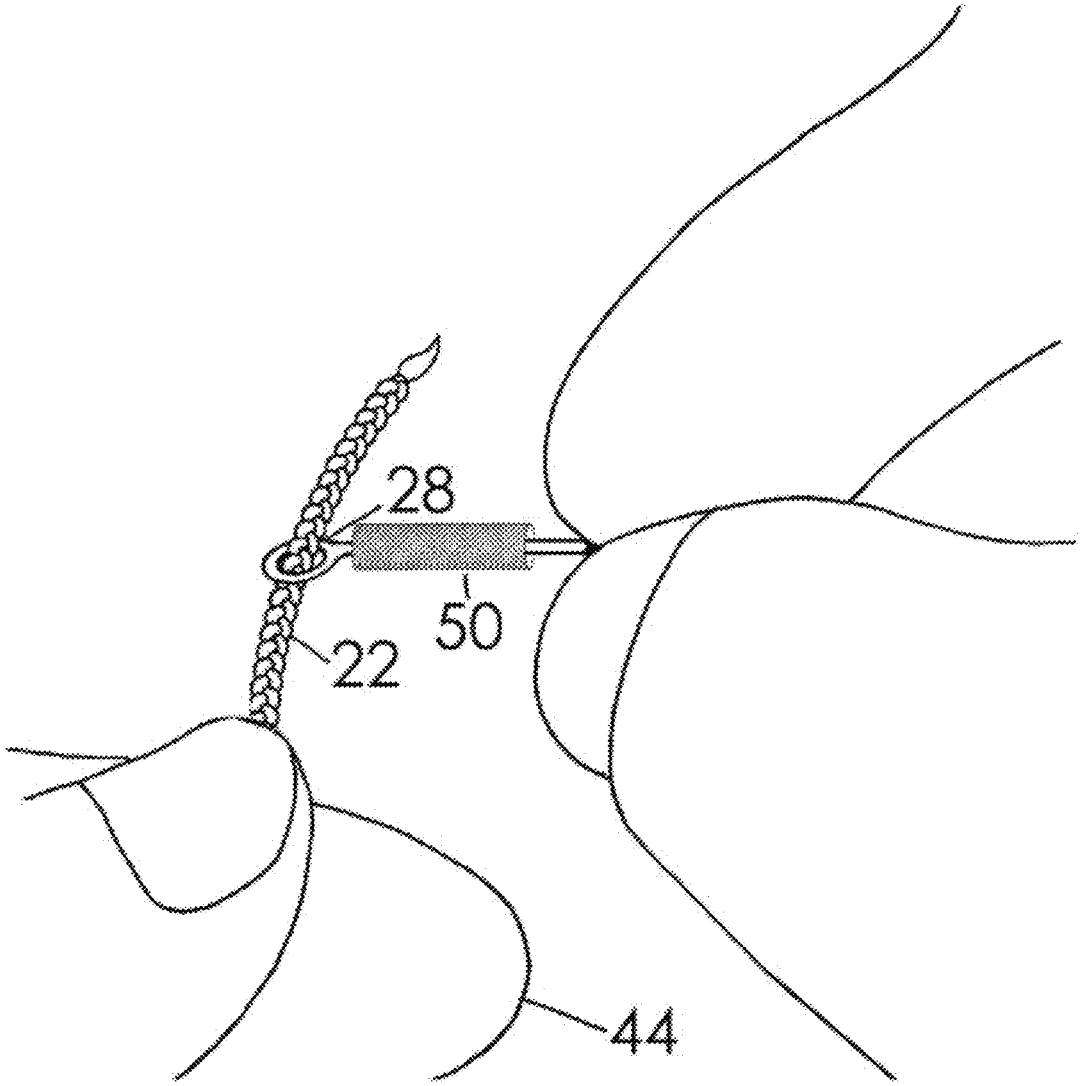
FIG. 5 schematically illustrates one example of an insertion process of a loc of human hair into an evolved hair tube.
Figure 6A:
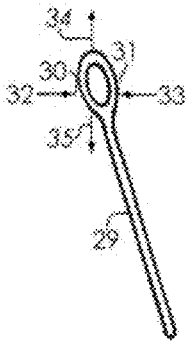
FIG. 6A-FIG. 6D schematically illustrate a preferred ring element used in the insertion process of the loc of human hair into the advanced hair tube.
Figure 6C:
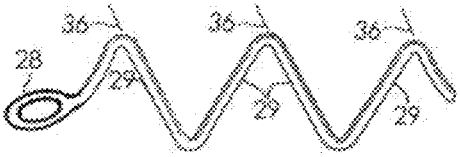
Figure 6B:
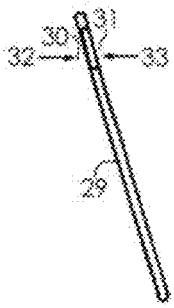
Figure 8:
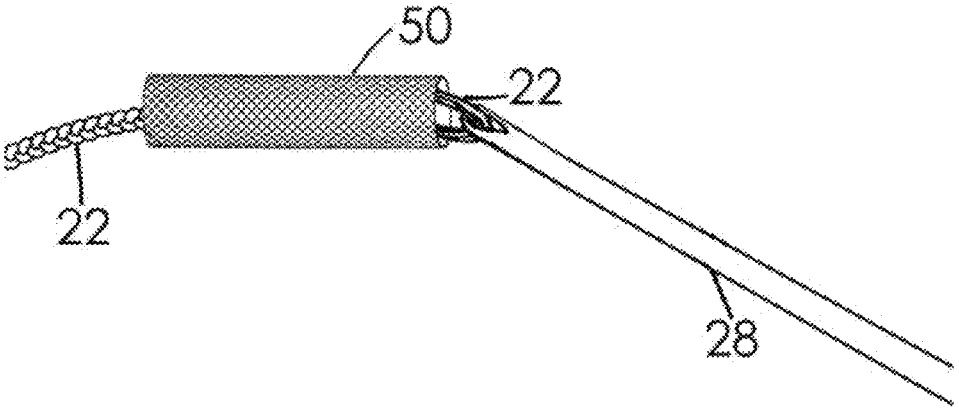

Referring now simultaneously to FIG. 5, FIG. 6B, FIG. 7 and FIG. 8 one example of an insertion process of the loc of human hair into the adapted hair tube is schematically illustrated. To facilitate insertion of the loc of human hair 22 into the adapted hair tube 50, a resilient ring shaped element 28 may be secured respectively to one end of the loc of human hair 22 and to the tube 50, as shown in FIG. 5. Normally the ring shaped element 28 is of oval form. When it is desired to insert a loc of human hair 22 into the evolved hair tube 50, a tube 50 is placed onto the straight portion of the ring element 29. The ring shaped element 28 is then held between thumb 27 and finger 44 positioned at 30 and 31 so that when manual pressure is applied as indicated by arrows 32 and 33 the ring 28 flattens around the loc of human hair 22 in the direction of arrows 34 and 35 to a linear form as shown in FIG. 6B and demonstrated in FIG. 7. Upon release of manual pressure 32, 33 on the ring 28, the advanced hair tube 50 is permitted to be inserted through the insertion orifice of the first open end 17 as shown in FIG. 8.

Figure 6D:
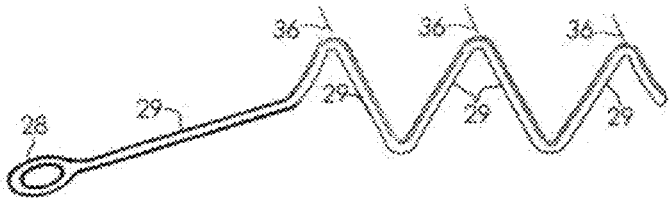
Figure 7:
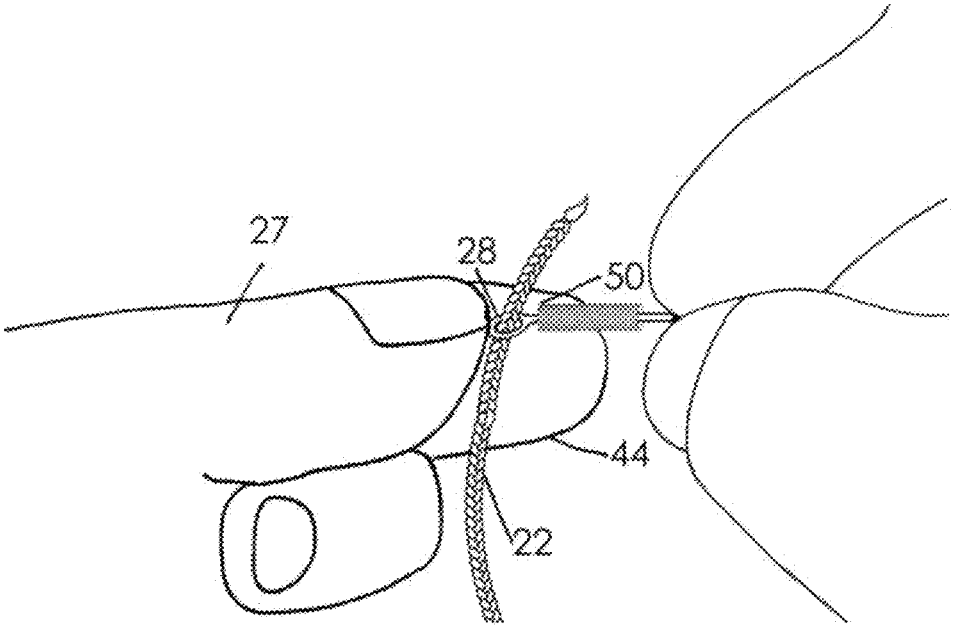
FIG. 7 and FIG. 8 schematically illustrate one example of an insertion process of the loc of human hair into the adapted hair tube.

After the loc of human hair 22 has been securely inserted into the modified hair tube 50, the mouth of the ring shaped element 28 is pulled in the opposite direction and the end of the loc of human hair 22 is released. The ring 28 reverts to the oval form as shown in FIG. 6A. It will be appreciated that the handle of the ring element 29 is also capable of being manipulated, through expansion and contraction to fit the length of the adapted hair tube 50, as illustrated in FIG. 6C and FIG. 6D Accordingly it is preferred to provide a ring shaped element 28 with the width of the ring 28 being approximately ¾ inches wide and the straight portion of the ring element 29 having a maximum length height of approximately 14 to 22 inches long and having a form illustrated in FIG. 6A-FIG. 6D.

Figure 9:
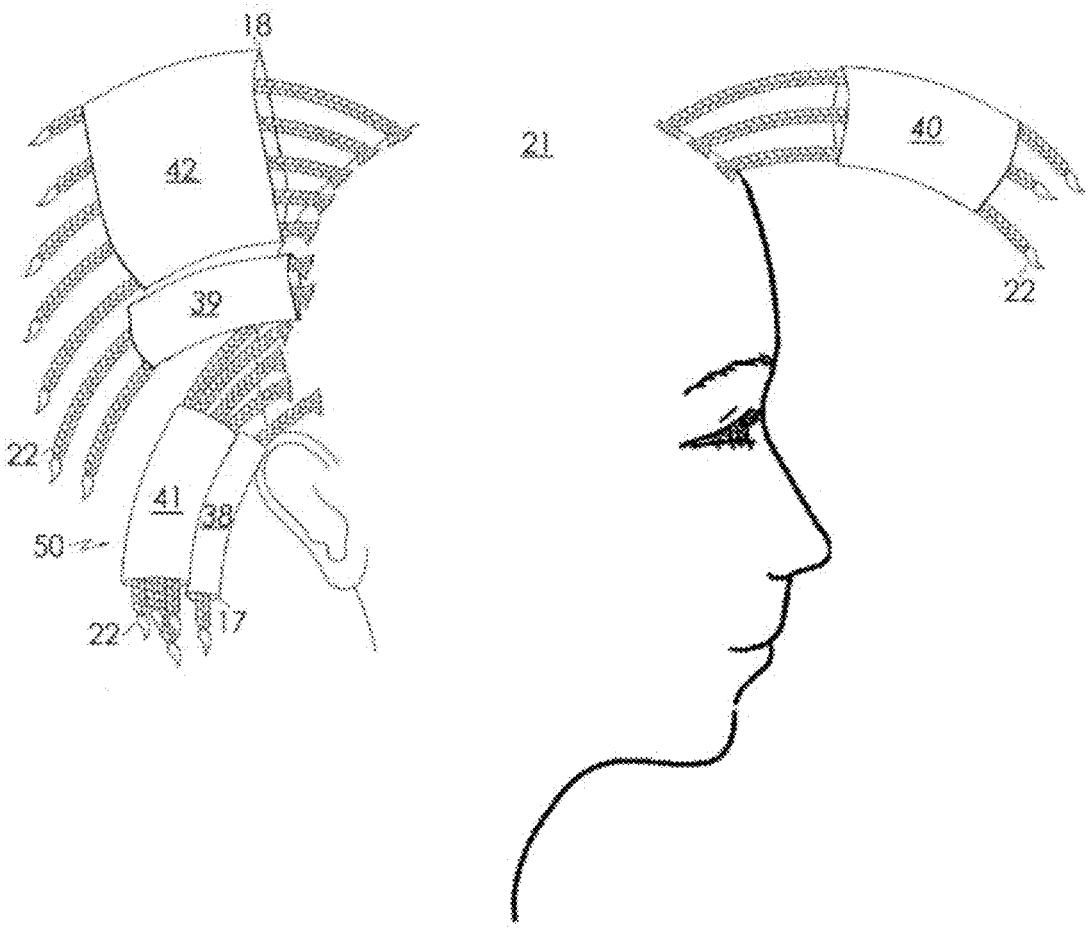
FIG. 9 schematically illustrates alternative formations of the evolved hair tubes in reference to width size wherein a tube retains either a single growing loc of natural hair or a selected small plurality thereof.

Referring now to FIG. 9, alternative formations of the evolved hair tubes in reference to width size wherein a tube retains either a single growing loc of natural hair or a selected small plurality thereof are schematically illustrated. Another aspect of the disclosed devices and methods relates to providing an alternative design formation in reference to width size wherein a tube 50 is adapted to encircle and retain either a single growing loc of natural hair 24 or a small plurality thereof and where tube 50 availability may enhance the desired appearance in the width of the hair 22, 24 up to five times the original dimension. In order to do this, and after the initial preparation of the locs, a secondary preparation is necessary to braid the individual locs of human hair 22 together before insertion into a wider evolved hair tube 50. As a result of the above preparation the growing locs of natural hair 24 are held in close proximity and this juxtaposition allows for the same result in the wider advanced hair tube 50 as when a single growing loc of natural hair 24 is used in the regular sized tube 50.

In further comprehending FIG. 9, it should be noted that the number of locs of human hair 22 in each variation of the modified hair tube 38, 39, 40, 41, 42, are first arranged in the secondary preparation, as described above with reference to step B of FIG. 4. The hair tubes would then be secured at the highest lateral portion of the hair shaft so as to touch the scalp 21. While a plurality of hair tubes of different width sizes are shown, this is for illustrative purposes only. It will be understood that, in most applications, only a singular width size would be worn in the hair at any given time.

In one example, the hair tube has a cross-sectional outer radius transverse to its length substantially equal to half the circumferential length of the inner surface of each opening. Both the device 50 and the method described above may include embodiments in which the adapted hair tube's 50 length from the top end to the bottom end is between approximately 1½ inches and 20½ inches and the radial distance is between 1/16 inches and 25/128 inches. In the smallest embodiment 38, the evolved hair tube's 50 length from top end to bottom end is 1½ inches and the radial distance is 1/16 inches.

In one embodiment 39, the advanced hair tube's 50 length from top end to bottom end is 3 inches and the radial distance is ⅛ inches. In another embodiment, the modified hair tube's 50 length from top end to bottom end is 6 inches and the radial distance is 1/16 inches. In another embodiment 40, the adapted tube's 50 length from top end to bottom end is 12 inches and the radial distance is 5/32 inches. In one embodiment 41, the evolved hair tube's 50 length from top end to bottom end is 12 inches and the radial distance is 23/128 inches. In the largest embodiment 42, the advanced hair tube's 50 length from top end to bottom end is 20½ inches and the radial distance is 25/128 inches.

Further, in the method described herein, the number of locs of human hair 22 held by each tube 50 may be selected from 1, 2, 3, 4, 5 and the lengths of the tubes 50 may be selected from 1½ inches, 3 inches, 6 inches, 12 inches, and 20½ inches and the color options are limitless. Thus, by using the hair tube 50 it is very easy to change the appearance of the hair treatment without detrimental manipulation.

Figure 12:
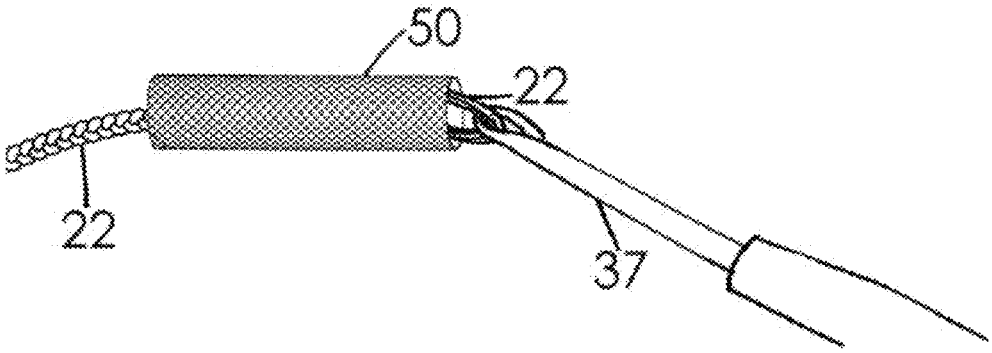

Referring now simultaneously to FIG. 10-FIG. 12, examples of insertion processes for a loc of human hair into the advanced hair tube are schematically illustrated. Insertion of the loc of human hair 22 into the modified hair tube 50 is also conveniently accomplished by use of a latch-hook 37 on an elongated handle. With the clasp 43 open, the latch-hook 37 is passed through the adapted hair tube 50 until it emerges and then is engaged with the loc of human hair 22 as showing in FIG. 10. The clasp 43 of the latch-hook 37 is then closed as in FIG. 11. The evolved hair tube 50 is then is inserted through the latch-hook 37 thereby drawing the loc of human hair 22 into and through the hair tube 50 and the hair tube 50 is applied thereto, such hair tube 50 being guided over the ligament of the growing loc of natural hair 24 as shown in FIG. 12.

However it will be appreciated that the latch-hook 37 should have a form that permits passage of the latch-hook 37 through the advanced hair tube 50 both during insertion and withdrawal without snagging the hair tube 50. Note here that in using the ring shaped element 28 rather than the latch-hook 37, superior operability is achieved because expansion and contraction is easily done by (a) bending 36 and (b) straightening the long piece of the ring element 28 which results in a tool that may easily be used with all modified hair tube 50 lengths.

The adapted hair tube disclosed herein may be regarded as a hair adornment device and can be worn for up to 12 months. It will be recognized that a plurality of similar or different esthetics may optionally be provided depending on the application or esthetics of the user. Where different, the appearance imparted by the evolved hair tube 50 according to any aspect of the present invention could be changed at will by substituting one esthetic color or width size for another. The hair tube itself gives the hair color and the tubes are so small that to any onlooker, it gives the illusion that the hair has been dyed.

From the prior description and drawings, it will be seen that a novel hair tube 50 is disclosed. The hair tube can be reused a number of times, thus providing a time, money and labor saver, a product that is safe, and reduces waste in the environment, and is inexpensive to make in all of its various forms. The improved structure is characterized by the advantages already pointed out, and by the additional advantages of rapidity and smoothness, and rapidity of manipulation.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. An esthetic hair treatment method comprising:

providing at least one lengthwise contractible cylindrical evolved hair tube wherein each lengthwise contractible cylindrically evolved hair tube is made by obtaining an inner sheet of a predetermined porosity, obtaining an outer sheet of a predetermined porosity including fibers that are more porous than the inner sheet, fabricating each hair tube by invisibly connecting the inner sheet to the outer sheet so that the inner sheet forms an inner wall of the hair tube and the outer sheet forms an outer wall of the hair tube, and the hair tube provides an interior channel extending lengthwise there through, where the at least one hair tube is thereby resiliently biased toward a preformed state;

after the inner and outer sheets have been connected to form the hair tube, shaping the inner and outer sheets into a lengthwise contracted or extended state and inserting at least one loc of a user's natural hair into and through the channel of the at least one hair tube while it is in the contracted or extended state so as to simultaneously apply the inner sheet and the outer sheet of each hair tube to cover a root portion of each loc of hair immediately adjacent the scalp;

then, permitting each hair tube containing at least one loc of hair to return to the preformed state after insertion of each loc of hair into each hair tube to allow natural hair growth of each inserted loc of hair to lie flat and straighten; and thereafter, applying a treatment including shampoo, conditioners, and/or oils to the scalp and hair so that both the inner sheet and the outer sheet are moistened and the treatment penetrates the hair tube to treat the root portions of hair covered thereby;

using the at least one hair tube as an adornment and allowing each loc of hair to grow through each respective hair tube until the natural hair growth reaches a selected length.

2. The method of claim 1, further comprising allowing all of the hair including the inserted locs and the at least one hair tube to dry.

3. The method of claim 2, wherein each hair tube has a length defined from a top end to an opposing bottom end between 1½ inches and 20½ inches; the channel/void the channel of the hair tube has a radius between 1/16 inches and 25/128 inches.

4. The method of claim 1 wherein the inserting step comprises:

securing a resilient ring shaped element having a mouth and a straight portion to one end of each loc of human hair;

placing the straight portion of the ring element through the at least one hair tube;

positioning the ring-shaped element and applying manual pressure until the ring flattens to a linear form;

releasing manual pressure on the ring to permit the loc of human hair to be inserted through the insertion orifice of the first open end; and after the loc of human hair has been securely inserted into the hair tube, pulling the mouth of the ring shaped element in the opposite direction to release the end of the loc of human hair.

5. The method of claim 1 wherein after the inserting step, flattening the at least one hair tube about a longitudinal axis thereof so that the cylindrical shape of the hair tube is distorted so as to impart a desired form of straightness.

6. The method of claim 1 wherein after the natural hair growth has reached the selected length, removing the at least one hair tube by gently pinching the hair between the scalp and the hair tube and pulling and guiding the hair tube down the hair shaft.

7. The method of claim 1 wherein the predetermined form of the at least one hair tube is of circular cross-section and is bendable about a lengthwise axis of the hair tube, and wherein the at least one hair tube are worn for up to 12 months.

8. The method of claim 1 wherein the at least one hair tube includes a plurality of hair tubes and the steps of shaping, inserting, permitting and applying are repeated with the plurality of hair tubes to cover additional locs of hair.

9. A method for treatment of a growing loc of natural hair comprising:

providing at least one lengthwise contractible cylindrical esthetic hair tube, the hair tube being contractible lengthwise from a lengthwise extended state to a lengthwise contracted state for straightening, adding slight volume to, coloring, decorating, and growing the natural hair without the application of heat or chemicals, wherein the at least one lengthwise contractible cylindrical esthetic hair tube is made by obtaining a sheet of a predetermined porosity having a first end and a second end, and connecting the first end to the second end before insertion of a growing loc of natural hair, where the sheet comprises interwoven fibers small enough to prevent debris from penetrating the growing loc of natural hair within the tube, but absorbent enough to adequately hold and release shampoo, oil and/or conditioner to hair within the hair tube;

applying one of the at least one lengthwise contractible cylindrical esthetic hair tube to a growing loc of natural hair by shaping the applied hair tube into the lengthwise contracted or extended state; and inserting the growing loc of natural hair into the at least one hair tube so that the hair tube is positioned at a root portion of the growing loc of natural hair immediately adjacent the scalp so as to cover new hair growth of the loc of hair;

permitting the applied hair tube containing the loc of hair to conform to the extended state after insertion of the loc of hair allowing natural hair growth to lie flat and straighten;

applying a treatment including shampoo, conditioners, and/or oils to the scalp and hair so the hair tube is moistened and the treatment penetrates the hair tube to treat portions of hair covered thereby; and using the at least one hair tube as an adornment and allowing each loc of hair to grow through each respective hair tube until the natural hair growth reaches a selected length.

10. The method of claim 9 further comprising: prior to applying the hair tube, a portion of the natural hair is braided into micro-braids and the remaining portion of natural hair is twisted into two-strand twists and where the inserting step is performed on a loc of hair formed into a micro-braid or two-strand twist and after the inserting step, pressure is applied to the hair tube to prevent relative displacement of the growing natural hair in a direction lengthwise of the hair tube.

11. The method of claim 10 further comprising a secondary preparation, prior to applying the hair tube, of braiding growing locs of natural hair together and then inserting the braided locs into the hair tube.

12. The method of claim 9 wherein the loc of hair is either a single growing loc of natural hair or a small plurality of growing natural hairs.

13. The method of claim 9 wherein the at least one hair tube includes a plurality of hair tubes and the steps of shaping, inserting, permitting and applying are repeated with the plurality of hair tubes to cover additional locs of hair.

* * * * *